US005451017A

United States Patent [19]

Graff et al.

[11] Patent Number: 5,451,017

[45] Date of Patent: Sep. 19, 1995

[54] AUTOMATIC TRACK SWITCHING CONTROL APPARATUS

[76] Inventors: John H. Graff; Roseann Narvett, both of 141 Northview Cir., Beaver, Pa. 15009

[21] Appl. No.: 180,316

[22] Filed: Jan. 12, 1994

[51] Int. Cl.[6] ..... B61L 7/00

[52] U.S. Cl. ..... 246/220; 246/122 A; 246/253; 246/314; 246/473.3

[58] Field of Search ..... 104/DIG. 1; 246/270 A, 246/322, 326, 360, 415 A, 415 R, 122 A, 220, 253, 314, 394, 473.3, 473 A, 169 A, 169 D, 169 R

[56] References Cited

U.S. PATENT DOCUMENTS

| | | | |
|---|---|---|---|
| D. 330,054 | 10/1992 | Plagborg | D21/108 |
| 1,840,014 | 1/1932 | Bergstein | 246/124 |
| 3,558,876 | 1/1971 | Douglaston | 246/169 |
| 3,802,121 | 4/1974 | Nielsen | 46/201 |
| 3,819,911 | 6/1974 | Greenaway | 235/61.11 E |
| 3,964,701 | 6/1976 | Kacerek | 246/2 F |
| 4,185,561 | 1/1980 | Reymann | 104/153 |
| 4,223,857 | 9/1980 | Hussein | 246/231 |
| 5,169,355 | 12/1992 | Tammera | 446/358 |

*Primary Examiner*—Robert J. Oberleitner
*Assistant Examiner*—Linh Do

[57] ABSTRACT

A new and improved automatic track switching control apparatus is provided for a switch assembly in a track layout for a lamp-containing model train. The automatic track switching control apparatus includes a first light sensor assembly which is supported by a base and which is located in the vicinity of a switch assembly in the track layout. The first light sensor assembly senses light emitted from a lamp on the lamp-containing model train as it approaches the switch assembly. A signal processing assembly is connected to the first light sensor assembly for receiving the electrical signal representing the approach of the lamp-containing model train to the first light sensor assembly. A switch-flipping assembly is connected to the signal processing assembly for receiving a second electrical signal for controlling switch status of the switch assembly. The signal processing assembly includes a counter assembly for counting first electrical signals provided by the first light sensor assembly. The counter assembly controls a pair of switch assemblies by way of the switch-flipping assembly. The counter assembly controls operation of a resistance clement for providing increased electrical resistance for electrical current supplied to the track layout, such that less current is available in the track layout for driving the lamp-containing model train that rides on the track layout, whereby speed of the lamp-containing model train is reduced when the resistance clement is placed in circuit with the track layout.

7 Claims, 3 Drawing Sheets

AUTOMATIC TRACK SWITCHING CONTROL APPARATUS

BACKGROUND OF THE INVENTION

1. Field of the Invention

The present invention relates generally to model trains and, more particularly, to track layouts for model trains that include track switches.

2. Description of the Prior Art

Track layouts for model trains can range from very simple to very complex. A continuous line of track can have many bends and curves. To add interest and realism to a track layout, the layout can include a number of switches. For many track routes, switches should be thrown in pairs. Yet, a natural tendency is to throw one switch at a time. In this respect, upon throwing one switch, one may forget to throw the other switch in the pair. In this respect, it would be desirable if a device were provided for model train track layouts that precluded problems associated with forgetting to throw a second switch in a pair of switches.

Problems associated with forgetting to throw a switch can be of two types. One type relates to route selection. The other type relates to potential derailment. In the first type of problem, a desired track route may be missed because a switch was not thrown at the appropriate time. In the second type of problem, if the switch is not thrown appropriately, the train will be derailed upon encountering a switch that is not oriented in the proper direction. In this respect, it would be desirable if a device were provided for model train track layouts that automatically throws a switch to automatically select a desired track route for the train to follow. Also, it would be desirable if a device were provided for model train track layouts which automatically throws a switch to automatically prevent train derailment.

Automatically operating devices generally employ some sort of sensor to sense a parameter upon which automatic operation is based. With respect to a model train, one characteristic that many model trains have in common is a headlight in an engine unit. In this respect, it would be desirable if a device were provided for model train track layouts that sensed the approach of the train by sensing light emitted from a headlight in the train engine.

Model trains are generally powered by a step-down transformer that steps down 120 VAC to a voltage ranging from 0–30 VAC. Transformers generally provide two type of voltage: a constant voltage for accessories; and a variable voltage for the engine. In this respect, it would be desirable if a device were provided for model train track layouts that automatically controlled switches by employing electric power derived from a constant voltage source on a step-down transformer.

Aside from automatic throwing of switches, there are other aspects of model train operation that a person may want to be operated automatically. It may be desirable to have a train slow down automatically at a predetermined location on the layout. Also, it may be desirable for a train to speed up automatically at another predetermined location on the layout. There may a location on the layout, such as a train station, where it may be desirable to have the train stop automatically. In this respect, it would be desirable if a device were provided for model train track layouts which automatically slows the train down, speeds the train up, and stops the train at predetermined locations on the track layout.

Throughout the years, a number of innovations have been developed relating to model trains and track layouts, and the following U.S. patents are representative of some of those innovations: U.S. Pat. Nos. 3,802,121; 3,964,701; 4,223,857; 5,169,355; and Des. 330,054. More specifically, U.S. Pat. No. 3,802,121 discloses a toy train that is not powered by an electric motor. It is pulled by a string.

U.S. Pat. No. 3,964,701 a model railroad control system which permits the independent, simultaneous operation of several model railroad train sets along a single track at variable speeds and in the forward and reverse direction as desired. Each train has a sensor that controls operation of the respective motor of each train. With this system, a special train must be provided along with special electrical power equipment. Currently, many model trains are in the possession of persons, and it would be desirable if automatic train operation could be implemented for currently owned engines and rolling stock without modifying the existing engines and rolling stock.

U.S. Pat. No. 4,223,857 discloses a switching arrangement for model trains in which a plurality of track paths are possible, depending on the status of the respective switches in the switching arrangement. An electronic apparatus is provided so that different track paths are traversed in a random fashion. The speed of the train determines the length of the signal produced by the switch selecting device. The operation of the switches is coordinated with the speed of the train. It would be desirable, however, of automatic operation of a track layout did not depend upon the speed of the train.

U.S. Pat. No. 5,169,355 discloses a toy station that has simulated passengers that move around on the station platform in simulation of person either about to board or just having disembarked from the train. The train is stopped for the simulated passengers to move about. Actual operation of the train itself is not provided by the toy station. U.S. Pat. No. Des. 330,054 discloses an ornamental design for a control unit for a toy train. Details as to operation of the control unit are not provided.

Thus, while the foregoing body of prior art indicates it to be well known to use devices for automatically throwing switches for model train track layouts, the prior art described above does not teach or suggest an automatic track switching control apparatus which has the following combination of desirable features: (1) precludes problems associated with forgetting to throw a second switch in a pair of switches; (2) automatically throws a switch to automatically select a desired track route for the train to follow; (3) automatically throws a switch to automatically prevent train derailment; (4) senses the approach of the train by sensing light emitted from a headlight in the train engine; (5) automatically controls switches by employing electric power derived from a step-down transformer used to operate the train; (6) automatically slows the train down, speeds the train up, and stops the train at predetermined locations on the track layout; (7) implements automatic train operation for currently owned engines and rolling stock without modifying the existing engines and rolling stock; and (8) does not depend upon the speed of the train. The foregoing desired characteristics are provided by the unique automatic track switching control apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved automatic track switching control apparatus for a switch assembly in a track layout for a lamp-containing model train, wherein the track layout is supported on a base. The automatic track switching control apparatus includes a first light sensor assembly which is supported by the base and which is located in the vicinity of a switch assembly in the track layout. The first light sensor assembly senses light emitted from a lamp on the lamp-containing model train as it approaches the switch assembly. The first light sensor assembly provides a first electrical signal which represents receipt of light emitted from the lamp-containing model train upon its approach to the first light sensor assembly. A signal processing assembly, is connected to the first light sensor assembly for receiving the electrical signal representing the approach of the lamp-containing model train to the first light sensor assembly. The signal processing assembly provides a second electrical signal for controlling switch status of the switch assembly. A switch-flipping assembly is connected to the signal processing assembly for receiving the second electrical signal for controlling switch status of the switch assembly.

The signal processing assembly includes a counter assembly for counting first electrical signals provided by the first light sensor assembly. The counter assembly controls a pair of switch assemblies by way of the switch-flipping assembly. The counter assembly controls operation of a resistance element for providing increased electrical resistance for electrical current supplied to the track layout, such that less current is available in the track layout for driving the lamp-containing model train that rides on the track layout, whereby speed of the lamp-containing model train is reduced when the resistance element is placed in circuit with the track layout.

A second light sensor assembly, supported by the base and located at a predetermined location along the track layout, is provided for sensing light emitted from the lamp-containing model train as it approaches the predetermined location along the track layout. The second light sensor assembly provides a third electrical signal representing receipt of light emitted from the lamp-containing model train upon its approach to the predetermined location along the track layout. The signal processing assembly includes a timer assembly which is controlled by operation of the second light sensor assembly. The timer assembly automatically stopping flow of electrical power to the lamp-containing model train after a predetermined period of time.

A track-current interrupter assembly, controlled by the timer assembly, is provided for interrupting electrical current flow from a power source to the track layout.

The first light sensor assembly includes a housing assembly for housing a light-sensitive assembly. The first light sensor assembly also includes a rotatable base assembly for supporting the housing assembly. The rotatable base assembly includes a fixed support member which is connected to the base. A rotatable member is fixed to the housing assembly and is received in the fixed support member for permitting rotation of the first light sensor assembly with respect to the base.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at the preferred embodiment(s) of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved automatic track switching control apparatus which has all of the advantages of the prior art and none of the disadvantages.

It is another object of the present invention to provide a new and improved automatic track switching control apparatus which may be easily and efficiently manufactured and marketed.

It is a further object of the present invention to provide a new and improved automatic track switching control apparatus which is of durable and reliable construction.

An even further object of the present invention is to provide a new and improved automatic track switching control apparatus which is susceptible of a low cost of manufacture with regard to both materials and labor, and which accordingly is then susceptible of low prices of sale to the consuming public, thereby making such automatic track switching control apparatus available to the buying public.

Still yet a further object of the present invention is to provide a new and improved automatic track switching control apparatus which precludes problems associated with forgetting to throw a second switch in a pair of switches.

Still another object of the present invention is to provide a new and improved automatic track switching control apparatus that automatically throws a switch to automatically select a desired track route for the train to follow.

Yet another object of the present invention is to provide a new and improved automatic track switching control apparatus which automatically throws a switch to automatically prevent train derailment.

Even another object of the present invention is to provide a new and improved automatic track switching control apparatus that senses the approach of the train by sensing light emitted from a headlight in the train engine.

Still a further object of the present invention is to provide a new and improved automatic track switching control apparatus which automatically controls switches by employing electric power derived from a step-down transformer used to operate the train.

Yet another object of the present invention is to provide a new and improved automatic track switching control apparatus that automatically slows the train down, speeds the train up, and stops the train at predetermined locations on the track layout.

Still another object of the present invention is to provide a new and improved automatic track switching control apparatus which implements automatic train operation for currently owned engines and rolling stock without modifying the existing engines and rolling stock.

Yet another object of the present invention is to provide a new and improved automatic track switching control apparatus that does not depend upon the speed of the train.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved automatic track switching control apparatus embodying the principles and concepts of the present invention will be described.

Figure 1:
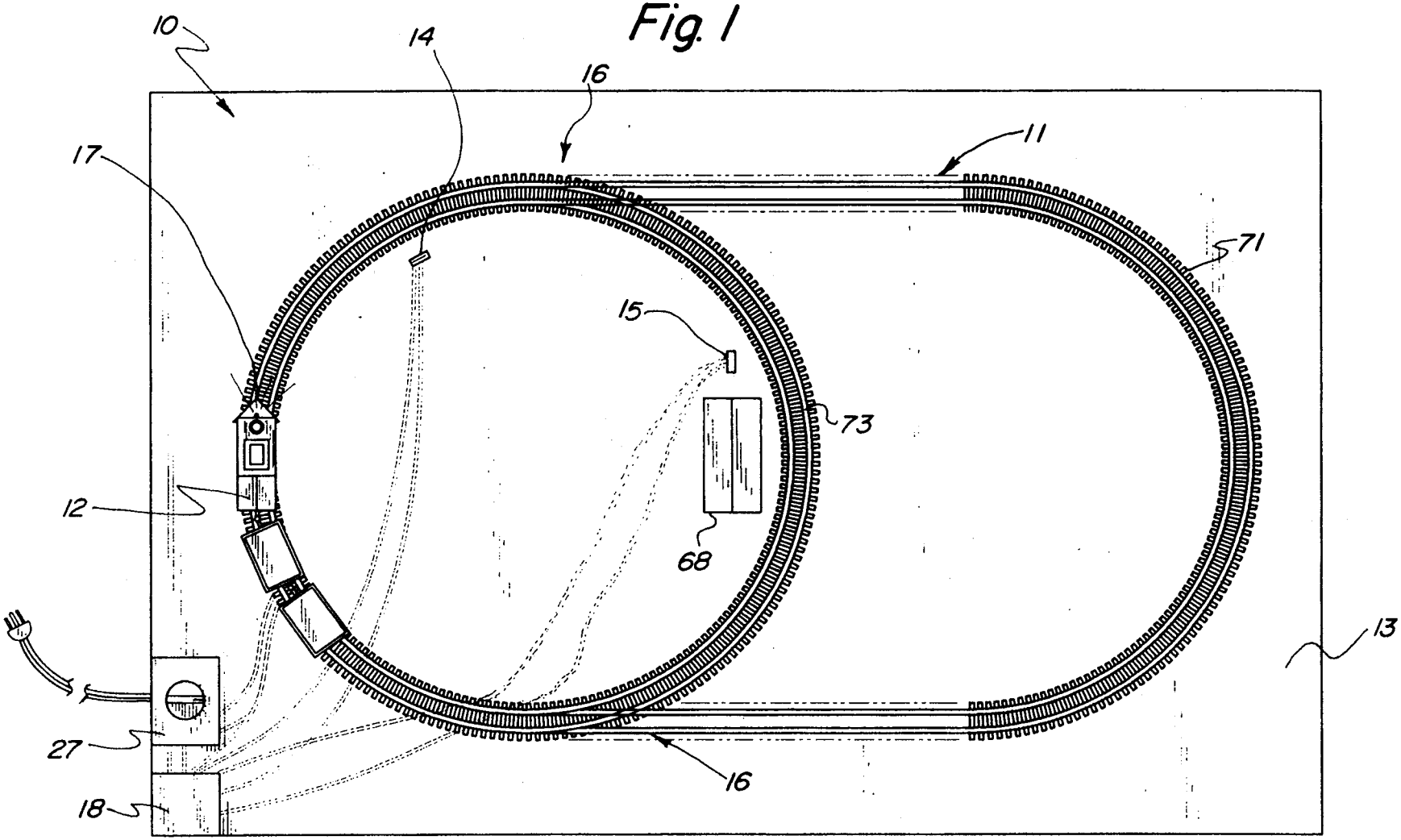
FIG. 1 is a top view showing a first preferred embodiment of the automatic track switching control apparatus of the invention on a track layout that includes a pair of switches.
Figure 2:
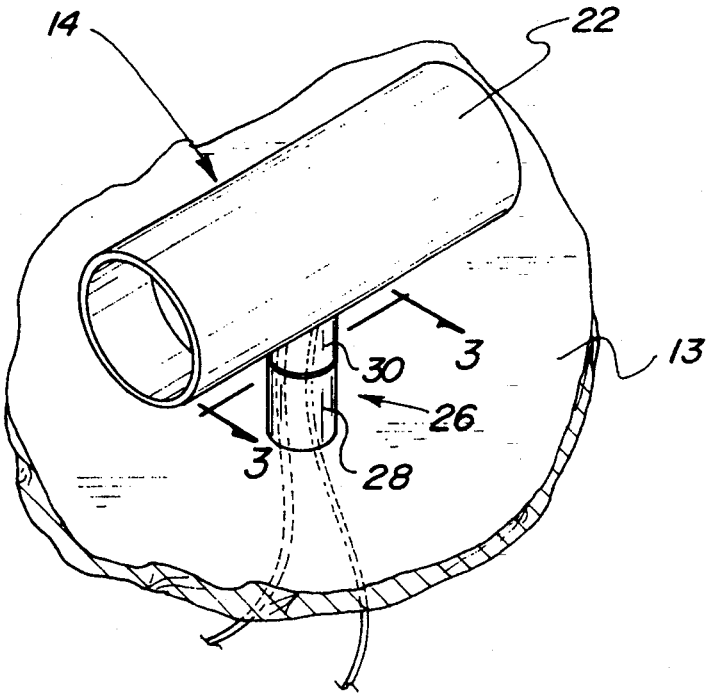
FIG. 2 is an enlarged perspective view a light sensor assembly employed with the embodiment of the automatic track switching control apparatus of FIG. 1.
Figure 3:
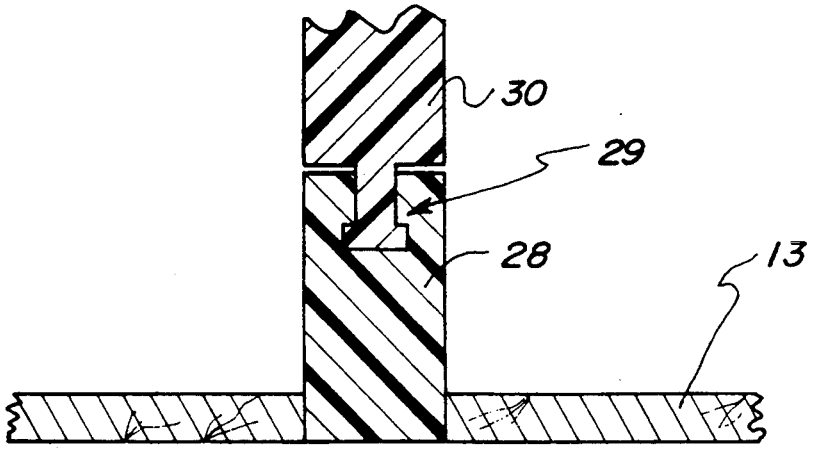
FIG. 3 is an enlarged partial cross-sectional view of the light sensor assembly shown in FIG. 2 taken along line 3—3 thereof.

Turning initially to FIGS. 1–3, there is shown a first exemplary embodiment of the automatic track switching control apparatus of the invention generally designated by reference numeral 10. In its preferred form, automatic track switching control apparatus 10 is provided for a switch assembly 16 in a track layout 11 for a lamp-containing model train 12, wherein the track layout 11 is supported on a base 13. The lamp-containing model train 12 and the track layout 11 are powered by an AC transformer 27. The automatic track switching control apparatus 10 includes a first light sensor assembly 14 which is supported by the base 13 and which is located in the vicinity of a switch assembly 16 in the track layout 11. The first light sensor assembly 14 senses light emitted from a lamp 17 on the lamp-containing model train 12 as it approaches the switch assembly 16. The first light sensor assembly 14 provides a first electrical signal which represents receipt of light emitted from the lamp-containing model train 12 upon its approach to the first light sensor assembly 14. A signal processing assembly 18, powered by an AC source such as the AC transformer 27, is connected to the first light sensor assembly 14 for receiving the electrical signal representing the approach of the lamp-containing model train 12 to the first light sensor assembly 14. The signal processing assembly 18 provides a second electrical signal for controlling switch status of the switch assembly 16. A switch-flipping assembly 20 is connected to the signal processing assembly 18 for receiving the second electrical signal for controlling switch status of the switch assembly 16.

The switch assembly 16 has a common straight end and two branches, one curved branch and one straight branch. A controllable track-switching element can be used to direct the lamp-containing model train 12 in one of two different track paths. In a first state of the switch assembly 16, the controllable track-switching element directs the lamp-containing model train 12 in a track path connecting the common straight end and the straight branch of the switch assembly 16. In a second state of the switch assembly 16, the controllable track-switching element directs the lamp-containing model train 12 in a track path connecting the common straight end and the curved branch of the switch assembly 16.

The signal processing assembly 18 includes a counter assembly 19 for counting first electrical signals provided by the first light sensor assembly 14. The counter assembly 19 controls a pair of switch assemblies 16 by way of the switch-flipping assembly 20. The counter assembly 19 controls operation of a resistance element 21 for providing increased electrical resistance for electrical current supplied to the track layout 11, such that less current is available in the track layout 11 for driving the lamp-containing model train 12 that rides on the track layout 11, whereby speed of the lamp-containing model train 12 is reduced when the resistance element 21 is placed in circuit with the track layout 11.

A second light sensor assembly 15, supported by the base 13 and located at a predetermined location along the track layout 11, is provided for sensing light emitted from the lamp-containing model train 12 as it approaches the predetermined location along the track layout 11. The second light sensor assembly 15 provides a third electrical signal representing receipt of light emitted from the lamp-containing model train 12 upon its approach to the predetermined location along the track layout 11. The signal processing assembly 18 includes a timer assembly 23 which is controlled by operation of the second light sensor assembly 15. The timer assembly 23 automatically stopping flow of electrical power to the lamp-containing model train 12 after a predetermined period of time.

A track-current interrupter assembly 25, controlled by the timer assembly 23, is provided for interrupting electrical current flow from a power source to the track layout 11.

Figure 4:
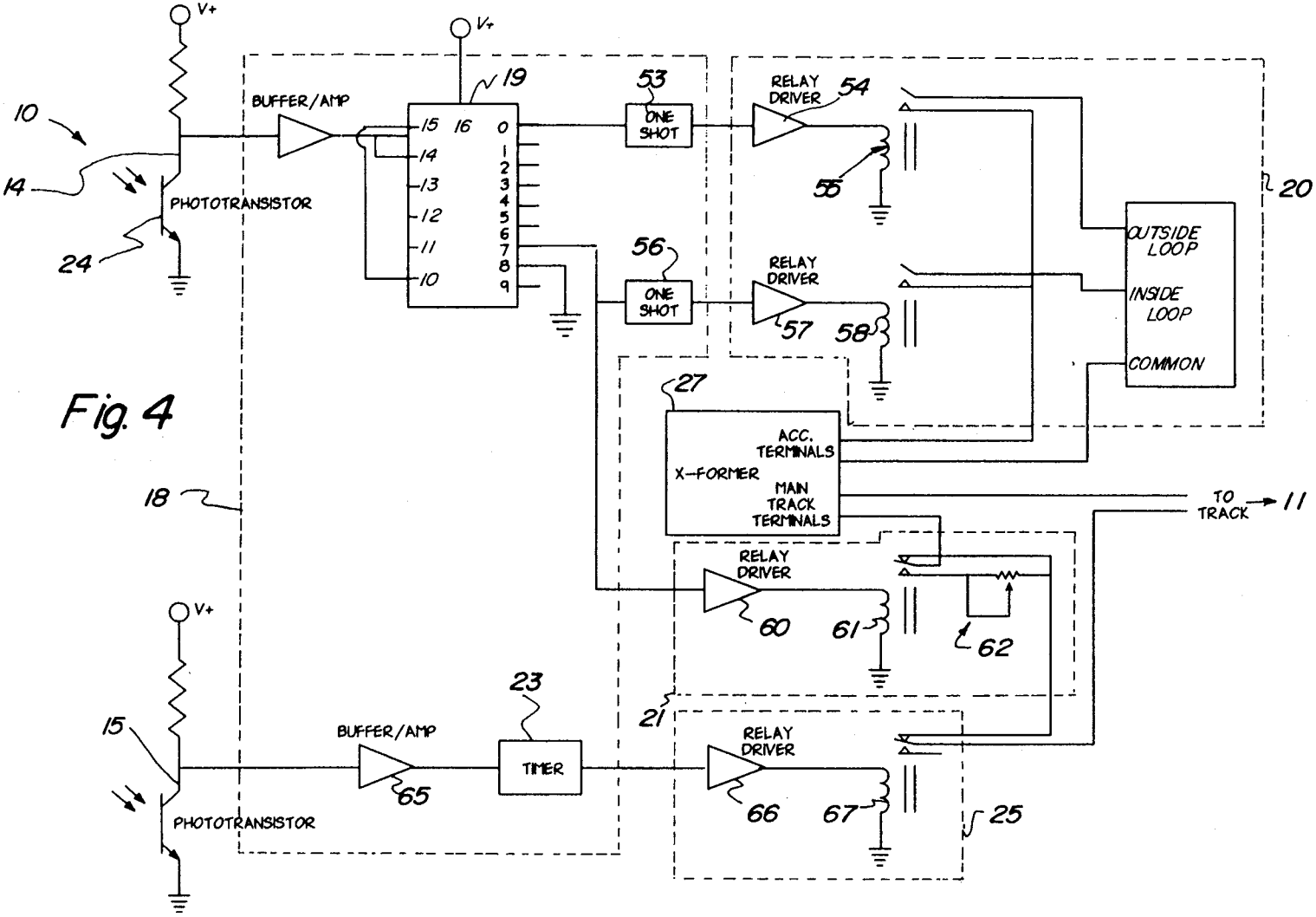
FIG. 4 is an electrical circuit diagram of an electrical circuit employed for operating the embodiment of the invention shown in FIG. 1.

Referring to the electrical circuit diagram illustrated in FIG. 4, operation of the embodiment of the automatic track switching control apparatus 10 of the invention shown in FIG. 1 is as follows. An AC to DC converter (not shown) converts AC power from the AC transformer 27 to DC power for powering all of the control circuitry. The light-sensitive assembly 24 includes a phototransistor, which, when receiving light from the lamp 17, provides a pulse to pin 14 of the counter assembly 19 (which is a 4017 integrated circuit). The decade counter then advances to pin 2 which is one time around the track layout 11 for the lamp-containing model train 12. When a signal is on pin 3 of the 4017 integrated circuit, a one-shot 53 and a relay driver 54 are powered for actuating a relay 55 that controls a right switch 16.

Pin 10 of the 4017 integrated circuit is connected to pin 15 of the 4017 integrated circuit. This makes the counter automatically recycle to zero. After the train goes the third time around the track, the 4017 circuit is at pin 7. When pin 3 of the 4017 integrated circuit is activated, the relay 55 causes the two switches 16 to switch so that the lamp-containing model train 12 rides along the large outside loop 71 of the track layout 11. On the other hand, when the pin 7 of the 4017 integrated circuit is activated, the two switches 16 are switched so that the lamp-containing model train 12 rides along the smaller inside loop 73 of the track layout 11. Activation of the pin 7 of the 4017 integrated circuit causes activation of one shot 56, relay driver 57, and relay 58.

The process of slowing down and stopping the lamp-containing model train 12 is carried out in the following way. Slowing the lamp-containing model train 12 down occurs when pin 7 of the 4017 integrated circuit drives relay driver 60 which drives relay 61 which connects rheostat 62 in circuit between the AC transformer 27 and the track layout 11. With the increased resistance in the circuit between the AC transformer 27 and the track layout 11, the motor in the lamp-containing model train 12 receives less power, and the lamp-containing model train 12 slows down.

When the second light sensor assembly 15 is stimulated by the lamp 17 of the lamp-containing model train 12, the buffer/amplifier 65 is activated, and this initiates the predetermined timing cycle of the timer assembly 23 which can be a 555 integrated circuit. After the predetermined period of time expires, the output of the timer assembly 23 is turned on, causing the relay driver 66 to activate relay 67 which opens the circuit for the track layout 11. That is, AC power from the AC transformer 27 is prevented from being applied to the track layout 11. In this way, power from the AC transformer 27 is precluded from reaching the lamp-containing model train 12, and the train stops running. The timer assembly 23 is provided so that the lamp-containing model train 12 stops running when it is at the train station 68 (shown in FIG. 1).

When the timer assembly 23 resets, the relay 67 is deactivated, and power flows again from the AC transformer 27 to the track layout 11 so that the lamp-containing model train 12 receives power and begins to run again. The cycle described above can be repeated over and over again automatically.

Referring to FIGS. 2 and 3, the first light sensor assembly 14 includes a housing assembly 22 which is provided for housing a light-sensitive assembly 24. A rotatable base assembly 26 supports the housing assembly 22. The rotatable base assembly 26 includes a fixed support member 28 which is connected to the base 13. A rotatable member 30 is fixed to the housing assembly 22 and is received in the fixed support member 28 for permitting rotation of the first light sensor assembly 14 with respect to the base 13. The rotatable member 30 is connected to the fixed support member 28 by a swivel assembly 29. By rotating the rotatable member 30 on the fixed support member 28, the angular orientation of the first light sensor assembly 14 can be adjusted for optimum pickup of light emitted from the lamp 17 in the lamp-containing model train 12 as it approaches the first light sensor assembly 14.

The components of the automatic track switching control apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved automatic track switching control apparatus that is low in cost, relatively simple in design and operation, and which may advantageously be used to preclude problems associated with forgetting to throw a second switch in a pair of switches. With the invention, an automatic track switching control apparatus is provided which automatically throws a switch to automatically select a desired track route for the train to follow. With the invention, an automatic track switching control apparatus is provided which automatically throws a switch to automatically prevent train derailment. With the invention, an automatic track switching control apparatus is provided which senses the approach of the train by sensing light emitted from a headlight in the train engine. With the invention, an automatic track switching control apparatus is provided which automatically controls switches by employing electric power derived from a step-down transformer used to operate the train. With the invention, an automatic track switching control apparatus is provided which automatically slows the train down, speeds the train up, and stops the train at predetermined locations on the track layout. With the invention, an automatic track switching control apparatus is provided which implements automatic train operation for currently owned engines and rolling stock without modifying the existing engines and rolling stock. With the invention, an automatic track switching control apparatus is provided which does not depend upon the speed of the train.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A combination of an automatic track switch control apparatus, a switch assembly, a track layout, and a lamp-containing model train supported on a base, the combination comprising:

a first light sensor assembly, supported by the base and located in a vicinity of a switch assembly in a track layout, for sensing light emitted from a lamp on the lamp-containing model train as it approaches the switch assembly, said first light sensor assembly providing a first electrical signal representing receipt of light emitted from the lamp-containing model train upon its approach to said first light sensor assembly, a signal processing assembly, connected to said first light sensor assembly, for receiving the electrical signal representing the approach of the lamp-containing model train to said first light sensor assembly, said signal processing assembly providing a second electrical signal for controlling switch status of the switch assembly, and a switch-flipping assembly, connected to said signal processing assembly, for receiving said second electrical signal for controlling switch status of the switch assembly, wherein said signal processing assembly includes a counter assembly for counting first electrical signals provided by said first light sensor assembly, and wherein said counter assembly controls a pair of switch assemblies by way of said switch-flipping assembly.

2. The apparatus described in claim 1 wherein said counter assembly controls operation of a resistance element for providing increased electrical resistance for electrical current supplied to the track layout, such that less current is available in the track layout for driving the lamp-containing model train that rides on the track layout, whereby speed of the lamp-containing model train is reduced when said resistance element is placed in circuit with the track layout.

3. The apparatus described in claim 1 further including:

a second light sensor assembly, supported by the base and located at a predetermined location along the track layout, for sensing light emitted from the lamp-containing model train as it approaches the predetermined location along the track layout, said second light sensor assembly providing a third electrical signal representing receipt of light emitted from the lamp-containing model train upon its approach to said predetermined location along the track layout.

4. The apparatus described in claim 3 wherein said signal processing assembly includes a timer assembly which is controlled by operation of said second light sensor assembly, said timer assembly automatically stopping flow of electrical power to the lamp-containing model train after a predetermined period of time.

5. The apparatus described in claim 4, further including:

a track-current interrupter assembly, controlled by said timer assembly, for interrupting electrical current flow from a power source to the track layout.

6. The apparatus described in claim 1 wherein said first light sensor assembly includes:

a housing assembly for housing a light-sensitive assembly, and a rotatable base assembly for supporting said housing assembly.

7. The apparatus described in claim 6 wherein said rotatable base assembly includes:

a fixed support member connected to the base, and a rotatable member fixed to said housing assembly and received in said fixed support member for permitting rotation of said first light sensor assembly with respect to the base.

* * * * *